US012092422B2

(12) United States Patent
Pagac

(10) Patent No.: US 12,092,422 B2
(45) Date of Patent: Sep. 17, 2024

(54) FIREARM MAGAZINE BASEPLATE REMOVAL AND INSTALLATION TOOL

(71) Applicant: Stephen J. Pagac, Tucson, AZ (US)

(72) Inventor: Stephen J. Pagac, Tucson, AZ (US)

( * ) Notice: Subject to any disclaimer, the term of this patent is extended or adjusted under 35 U.S.C. 154(b) by 0 days.

(21) Appl. No.: 18/358,688

(22) Filed: Jul. 25, 2023

(65) Prior Publication Data

US 2024/0044604 A1 Feb. 8, 2024

Related U.S. Application Data

(60) Provisional application No. 63/370,613, filed on Aug. 5, 2022.

(51) Int. Cl.
*F41A 9/83* (2006.01)
*F41A 9/65* (2006.01)
*F41A 35/00* (2006.01)

(52) U.S. Cl.
CPC ..... *F41A 9/83* (2013.01); *F41A 9/65* (2013.01); *F41A 35/00* (2013.01)

(58) Field of Classification Search
CPC ..... F41A 9/61; F41A 9/63; F41A 9/65; F41A 9/68; F41A 9/71; F41A 9/83; F41A 9/84; F41A 35/00; F41A 99/00
USPC ..... 42/108
See application file for complete search history.

(56) References Cited

U.S. PATENT DOCUMENTS 2,289,067 A * 7/1942 Owsley ..... F41A 9/68 42/50
4,570,371 A * 2/1986 Mears ..... F41A 9/83 42/87
8,793,919 B1 * 8/2014 Probst, Jr. ..... F41C 27/00 42/108
9,791,250 B1 * 10/2017 Pestana ..... F42B 39/02
11,029,108 B1 * 6/2021 Tal ..... F41A 9/84
11,644,257 B1 * 5/2023 Roe ..... F41A 9/71 42/6
11,841,204 B2 * 12/2023 Morris ..... F41A 35/00
2003/0140461 A1 * 7/2003 Wilcock ..... A44B 11/2569 24/191

(Continued)

FOREIGN PATENT DOCUMENTS

WO WO-2007034027 A1 * 3/2007 ..... F41A 17/38

*Primary Examiner* — Joshua E Freeman
*Assistant Examiner* — Benjamin S Gomberg

(57) ABSTRACT

Apparatus and method for implementation of multiply-repeated removal and/or reinstallation of an element terminating the body of the firearm magazine. The apparatus includes a receiving body having opposing walls judiciously separated by a distance sufficient to receive the magazine in-between, and a release cam hingedly cooperated with such body to move a camming element of the cam move in an out of the space between the walls. The method involves completely disengaging the locking tab(s) of the body of the magazine from the corresponding notch(es) at the terminating element prior to separation of the terminating element from the body of the magazine by carrying out precisely dimensioned, repeatable and multiply reproducible elastic compression of the body of the magazine with the use of release cam(s) and holding the wall(s) of the body of the so-compressed magazine in their elastically-bent form at least for the time required to remove or re-install the structural terminating element.

19 Claims, 12 Drawing Sheets

(56) References Cited

U.S. PATENT DOCUMENTS

| | | | | |
|---|---|---|---|---|
| 2009/0235569 | A1* | 9/2009 | Morando | F41A 9/65<br>42/108 |
| 2010/0175294 | A1* | 7/2010 | Meinel | F41A 9/83<br>42/87 |
| 2014/0109451 | A1* | 4/2014 | Beckman | F41A 9/83<br>42/6 |
| 2016/0370138 | A1* | 12/2016 | Zamm | F41A 9/66 |
| 2017/0051992 | A1* | 2/2017 | Cottrell | F41A 9/83 |
| 2018/0010881 | A1* | 1/2018 | Garst | F41A 11/02 |
| 2019/0249969 | A1* | 8/2019 | Griffith | F41A 17/38 |
| 2019/0285374 | A1* | 9/2019 | Bowler | F41A 9/71 |
| 2021/0140730 | A1* | 5/2021 | DeJessa | F41A 9/71 |
| 2023/0175798 | A1* | 6/2023 | Halbeisen | F41A 9/83<br>42/87 |
| 2024/0044604 | A1* | 2/2024 | Pagac | F41A 35/00 |

* cited by examiner

FIG. 1
(PRIOR ART)
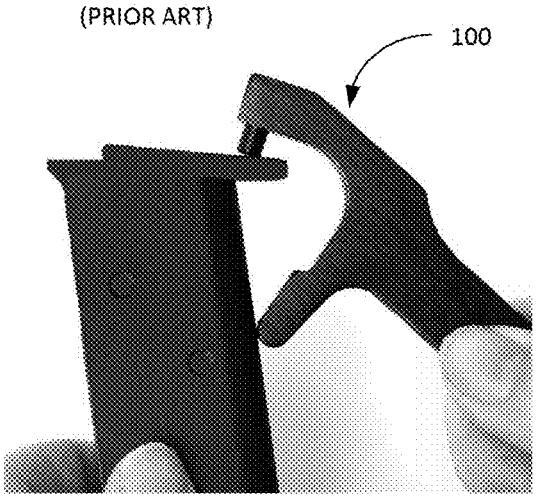
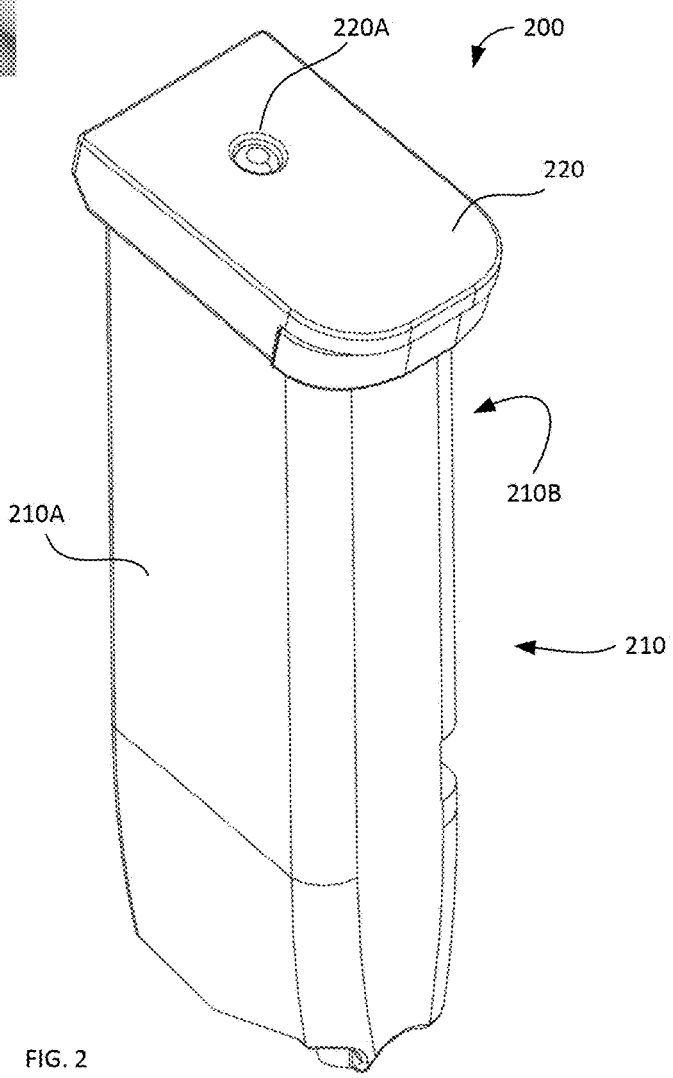
FIG. 2

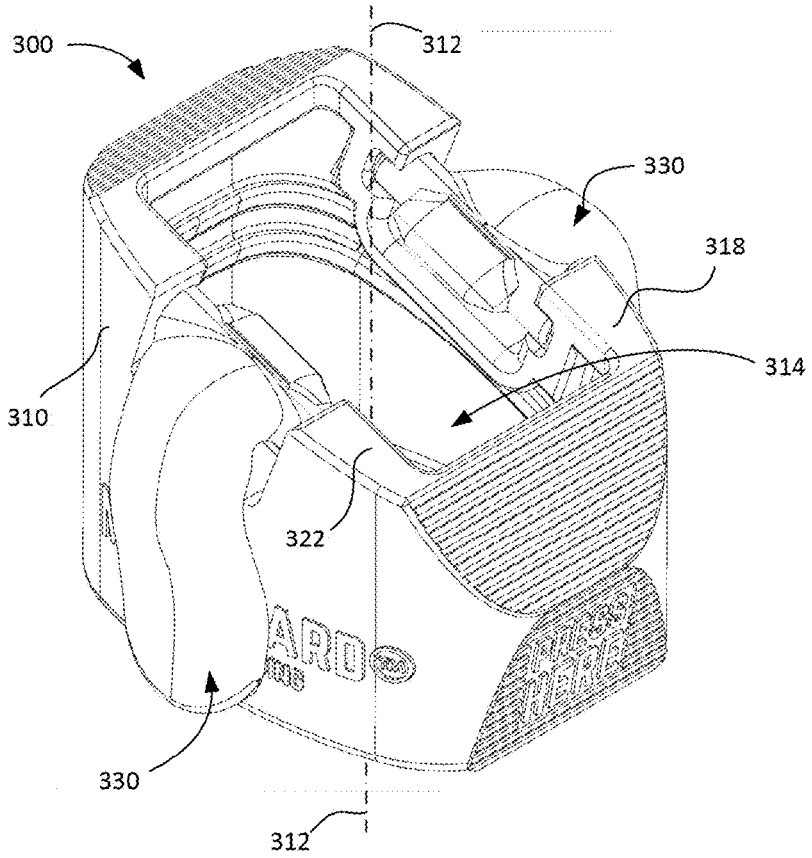
FIG. 3A
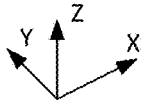
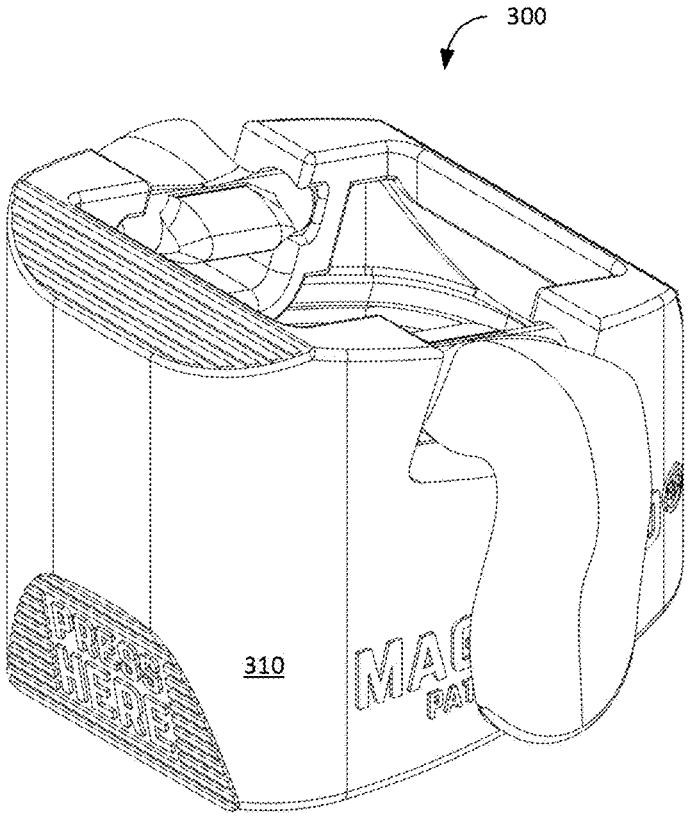
FIG. 3B
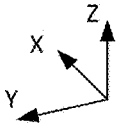

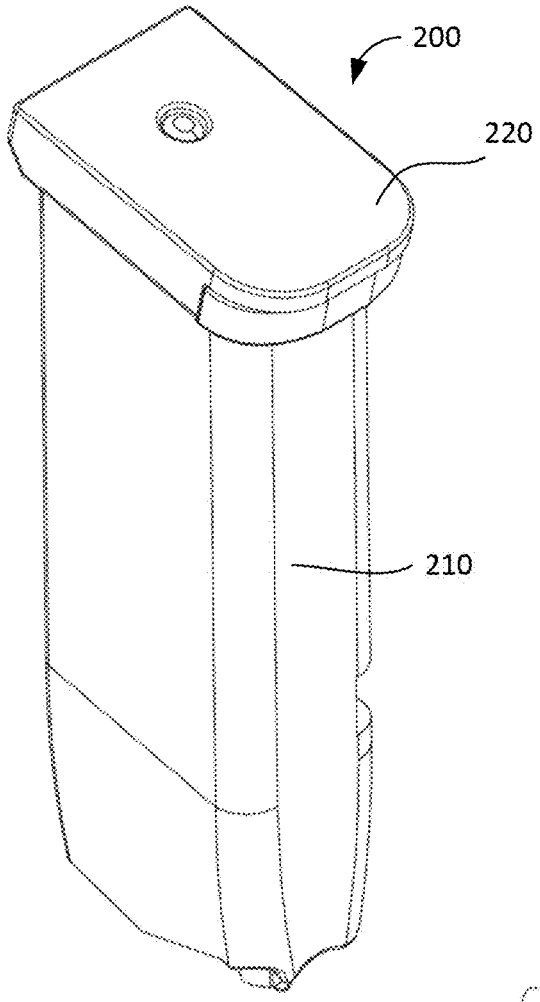
FIG. 6A
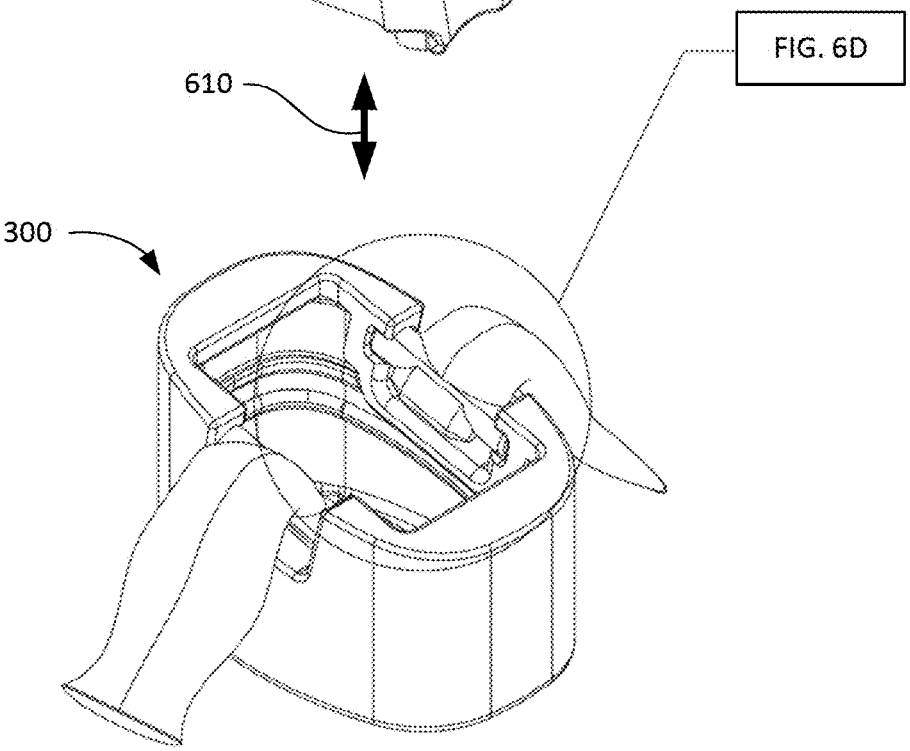

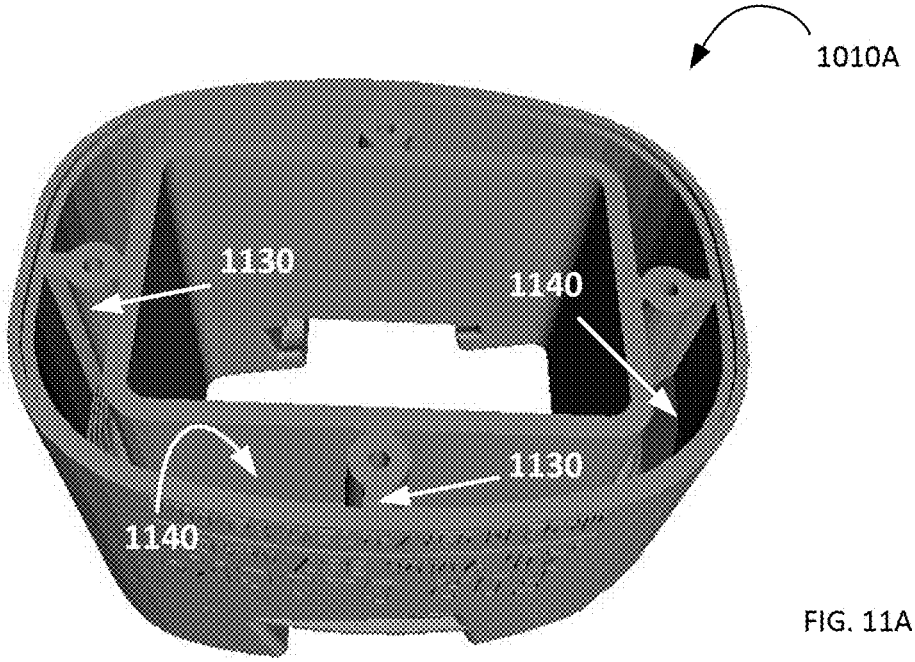
FIG. 11A
FIG. 11B
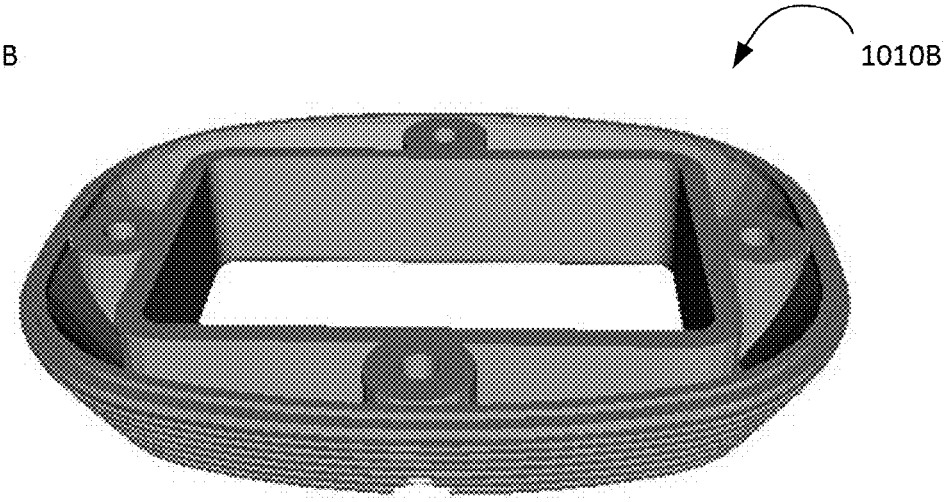

FIREARM MAGAZINE BASEPLATE REMOVAL AND INSTALLATION TOOL

CROSS-REFERENCE TO RELATED APPLICATIONS

This application claims the priority from and the benefit of U.S. Provisional Patent Application No. 63/370,613, filed on Aug. 5, 2022 and titled "Firearm Magazine Baseplate Removal Tool", the disclosure of which is incorporated by reference herein.

TECHNICAL FIELD

The present invention relates at least in part to tools used for servicing firearms. In one instance, the invention relates to a tool configured to assist in removal and/or installation of a baseplate and/or extension from/to a firearm magazine.

RELATED ART

In context of firearms, a magazine is an ammunition storage and feeding device within or attached to a repeating firearm. Magazines may be integral to the firearm (fixed) or removable (detachable). The most common type of magazine is the detachable "box" type that holds the projectiles (which are most commonly spring loaded when packed inside and pushed into the firearm by the spring) in columns. The cartridges in the magazine are loaded or fed into the firearm's chamber either automatically or manually depending on the firearm, but almost always by a spring. To function reliably and safely, a firearm must be clean. One common area of firearm malfunction, especially in the field (i.e., hunting, a law enforcement operation or military combat), is dirt or debris inside the magazine which interferes with the proper loading of ammunition from the magazine to the chamber. This brings a need in a tool that allows quick and easy access to the magazine's tube, via removal of the magazine's baseplate (which sometimes is referred to as a floorplate), so that the magazine tube and spring can be cleaned to insure proper operation. Additionally or in the alternative, it may be desired to exchange the baseplate for an accessory that will either increase the capacity of the magazine or lengthen the grip (which accessory may be interchangeably referred to herein as an extension).

Some firearms, such as some Glock® pistols for example, have magazines that are commonly recognized to be very difficult to disassemble and clean. One commonly used but not particularly regarded method of removing a magazine's baseplate involved using a pliers-resembling device to remove the floorplate. In operation, the pliers' beaks must be held in place, while the handles are at a distance from the magazine, making it difficult to apply pressure on the locking tabs of the magazine, to maintain control of the magazine, and to manipulate the release of the floorplate with the other hand. This method is well known to often lead to damaging the locking tabs of the magazine, therefore rendering this important feature of the magazine substantially non-functional after a couple of iterations of the baseplate removal. Other unconventional types of magazine tools used for releasing the tabs on the magazine (such as vice grips, channel locks, c-clamps and other devices that exert pressure to the area around the locking tabs) simply do not and cannot provide a consistent calibrated force to release the locking tabs on the magazine, thereby substantially failing to prevent damage to the magazine itself. In particular, all these commonly used non-standardized methods often result in exertion (application to the magazine) of force insufficient for full disengagement of the locking tabs of the magazine from the corresponding locking notches of the base plate. This, understandably and recognizably, leads to inevitable stripping the locking tabs off the magazine and/or stripping off at least parts of the tabs that keep the baseplate in place when the baseplate is forced off. On the other side of the spectrum of application of inconsistent releasing force, applying too much force to the magazine can potentially damage the container portion of the magazine. This type of damage may compromise the intended use, safety, and dependability of the firearm altogether. Similarly, the use of a type of a commercially produced tools — such as that depicted as 100 in FIG. 1 (see, for example, ar15basics.com/magazine-base-floor-plate-removal-grip-for-glock-17-19-20-21-25-26-43-pistol-gun-9mm-mag-baseplate-disassembly-tool-accessories)—do not even consider applying the pressure to the body of the magazine to reposition its locking tabs, thereby most certainly stripping at least a portion of the tabs during repeated operation.

The detrimental results of inconsistent and non-repeatable use of various non-standardized for the purpose, house-made, and/or not-intended-for-the-purpose tools begs a question of whether such methodology can be developed that reliably and repeatable guards against potentially damaging the magazine during baseplate disassembly and reassembly, while at the same time providing consistent performance and results every time it is used. Embodiments of the present invention provide for application of operationally-sufficient and repeatable amount of force along the locking tabs of the magazine to repeatably and fully—not partially, in stark contradistinction with the above-discussed methods—disengage the locking tables of the magazine from the baseplate, thereby allowing the baseplate to be removed and/or re-installed not only properly but also without affecting the shape of the locking tabs. Embodiments of the invention prevent the damage to the locking tabs and/or the magazine by ensuring the application of pre-calibrated and highly repeatable amount of force to the magazine, without compromising the safety and dependability of the magazine and ultimately for the firearm itself.

SUMMARY OF THE INVENTION

Embodiments of the invention provide a projectile container tool, which includes at least a receiving body and at least one release cam. The receiving body has an axis and includes first and second wall portions that are opposite to one another, that extend along the axis, and that are separated from one another in a plane transverse to the axis by a distance such as to form an internal opening of the receiving body. (The internal opening is judiciously dimensioned to removably accommodate a body of a projectile container between the first and second wall portions.) The at least one release cam has a cam lever and a camming body and is configured to be hinged at an edge region of a chosen wall portion of the first and second wall portions with the camming body positioned in the internal opening and the cam lever being outside of the wall. Substantially in any implementation, the tool may be dimensioned to have the distance separating the first and second wall portion satisfy a requirement of a running fit and/or a requirement of a sliding fit between the body of a projectile container and a surface of the receiving body (with such running fit or such sliding fit is defined according to ANSI B4.1 standard, as followed by related art).

Embodiments of the invention additionally provide a method that includes the steps of (i) removably inserting a body of a projectile container into the internal opening of the receiving body of the projectile container tool along the axis; and (ii) hingedly rotating the at least one release cam about a hinge thereof disposed at a wall portion of the receiving body to engage the camming body of the at least one release cam with a surface of the body of a projectile container and to release a locking tab of the body of the projectile container from a corresponding tab-accommodating notch of a structural element that is removably cooperated with the body of the projectile container to terminate the body of the projectile container. In at least one implementation, the method may additionally include a step of disconnecting the structural element from the body of the projectile container by moving the structural element in a first direction, and/or the step of removably securing the structural element at the body of the projectile container by (a) moving the structural element in a second direction that is opposite to the first direction until the tab-accommodating notch of the structural element is substantially aligned with the locking tab of the body of the projectile container while such body of the projectile container is engaged with the camming body in the internal opening of the receiving body, and (b) hingedly rotating the at least one release cam about the hinge thereof to disengage the camming body of the at least one release cam from the surface of the body of the projectile container.

Substantially in every implementation of the method, the method may be characterized by at least one of the following features: (i) the step of removably inserting may include inserting the body of a projectile container into a hollow of the receiving body configured as a tubular element; (ii) the step of removably inserting may include inserting the body of a projectile container into the internal opening of the receiving body when the at least one release cam is oriented with the cam not protruding into the internal opening and the cam lever being substantially transverse to an outer surface of the receiving body, or the step of removably inserting may include inserting the body of a projectile container into the internal opening of the receiving body when the at least one release cam is oriented with the camming body not protruding into the internal opening and the cam level extending along the outer surface of the receiving body. In at least one specific case of the latter (when the projectile container includes a firearm magazine, and then structural element includes a baseplate of the firearm magazine), the method may further include a step of repositioning an internal element of the firearm magazine by engaging a repositioning element with the internal element through an opening in the baseplate.

BRIEF DESCRIPTION OF THE DRAWINGS

The invention will be more fully understood by referring to the following Detailed Description of Specific Embodiments in conjunction with the Drawings, of which:

FIG. 1 illustrates the application of a tool of related art to a firearm magazine in the process of removal of the baseplate.

FIG. 2 provides a perspective view of a typical projectile container (here—a firearm magazine), showing the baseplate attached to (cooperated with) the body of such container.

FIGS. 3A, 3B illustrate a (monolithic) embodiment of the invention in perspective views.

FIG. 6A provides a perspective view of the embodiment of the tool of the present invention illustrating the manner in which the projectile container is inserted into (cooperated with) the embodiment of the tool.

FIG. 9B provides a view from the bottom; FIG. 9C provides a view from the top, and FIG. 9D provides a view from the right.

FIG. 10A is a view from the top; FIG. 10B is a view from the bottom; FIG. 10C is a view from the left; FIG. 10D is a view from the right; FIG. 10E is a view from the front; and FIG. 10F is a view from the back.

FIGS. 11A, 11B schematically show, in corresponding perspective views, the top and bottom portions of the multiple-part-containing receiving body of the embodiment of FIGS. 10A-10F, thereby illustrating some details of internal structure of such body.

Figure 4:
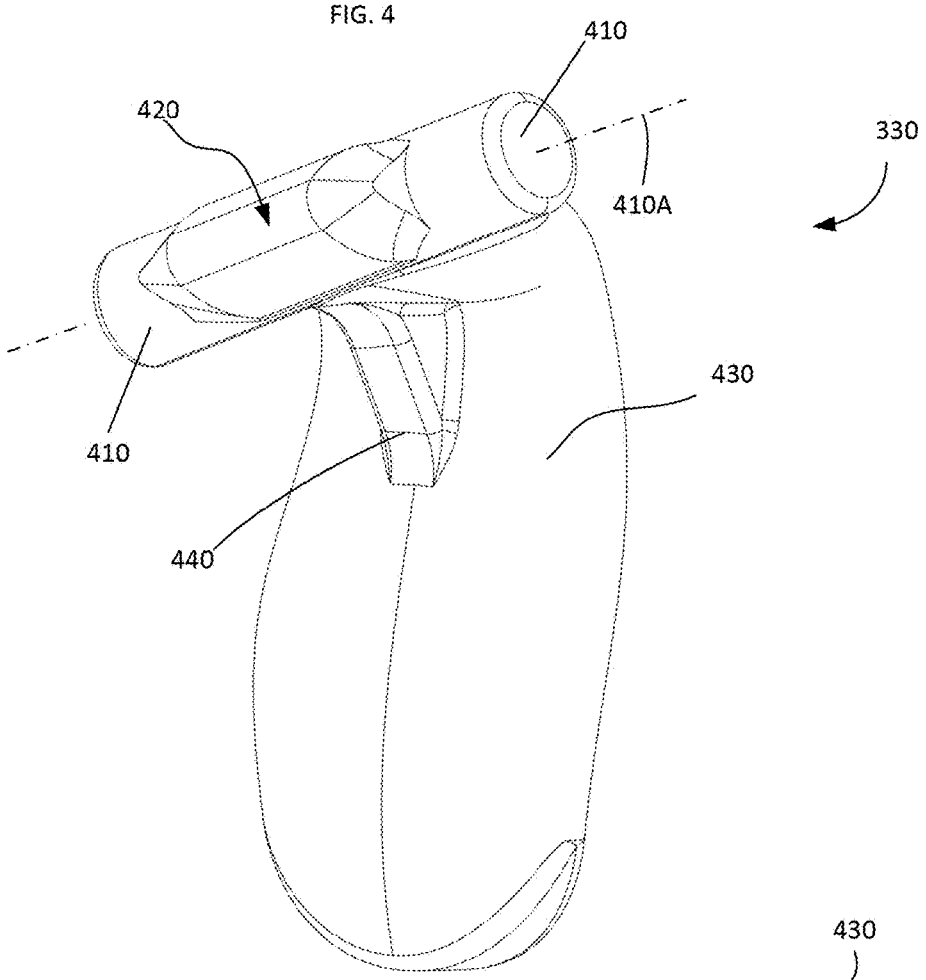
FIG. 4 illustrates a constituent release cam of an embodiment of the invention.

Generally, the sizes and relative scales of elements in the Drawings may be set to be different from actual ones to appropriately facilitate simplicity, clarity, and understanding of the Drawings. For the same reason, not all elements present in one Drawing may be necessarily shown in another.

DETAILED DESCRIPTION

Most generally, implementations of the idea of the invention provide a projectile container tool judiciously designed to be utilized in cooperation with a projectile container—such as a firearm magazine, for example. Such tool includes a receiving body and at least one release cam. The receiving body of the tool includes first and second wall portions opposite to one another and extending along the axis of the receiving body such as to be from one another in a plane transverse to the axis by a distance and such as to form an internal opening of the receiving body. This internal opening is specifically dimensioned to removably accommodate a body of a projectile container between the first and second wall portions. To appreciate the structure of the tool, FIG. 2 provides a schematic depiction of an embodiment 200 of a firearm magazine—that in operation is cooperated with the tool of the invention. The embodiment 200 has a box-type body 210 removably closed, at one end, with a structural terminating element 220 (which in the shown case is a baseplate) which—in operation of the magazine—has to be repeatedly attached to and dis-attached from the body 210. The body 210 has opposing each other walls 210A, 210B. Not visible in FIG. 2 are locking tabs of the body 210 and the respectively-corresponding tab-accommodating notches of the terminating element 220 (each of which is hidden from the view by the edges of the terminating element in FIG. 2).

Implementations of the idea of the invention solve the persistent problem currently-used methodologies are facing—specifically, the problem of compromising the structural integrity and critical function of the projectile container (such as a firearm magazine) as a result of repeated removal and/or reinstallation of the structural element terminating the body of the projectile container (referred to herein as a structural termination element). Specifically, the discussed implementations substantially reduce and, in fact, substantially completely eliminate the problem of wearing out or even stripping the locking tabs of a body of a projectile container during the repeated removal and/or reinstallation of the structural element terminating the body of the magazine by ensuring that highly repeatable, consistent in value pressure is applied to the body of the projectile container each and every time the disclosed tool is employed, sufficient enough—to completely disengage the locking tab(s) of the body of the magazine from the corresponding tab-accommodating notch(es) at the terminating element prior to separation of the structural terminating element from the body of the magazine. Such meticulous operation is ensured by carrying out precisely dimensioned, repeatable and multiply reproducible elastic compression of the body of the magazine with the use of release cam(s) of an embodiments of the tool of the invention and holding the wall(s) of the body of the so-compressed magazine in their elastically-bent form at least for the time required to remove or re-install the structural terminating element. As a skilled person readily appreciates, the structural termination element may be a baseplate (shown in FIGS. 2A, 2B and having an opening 220A therethrough) or a magazine extension, for example. For simplicity, the following discussion is carried out with the use of the example of the baseplate, and an embodiment of the invention may be interchangeably referred to as a baseplate removal (and/or installation) tool.

Figure 5:
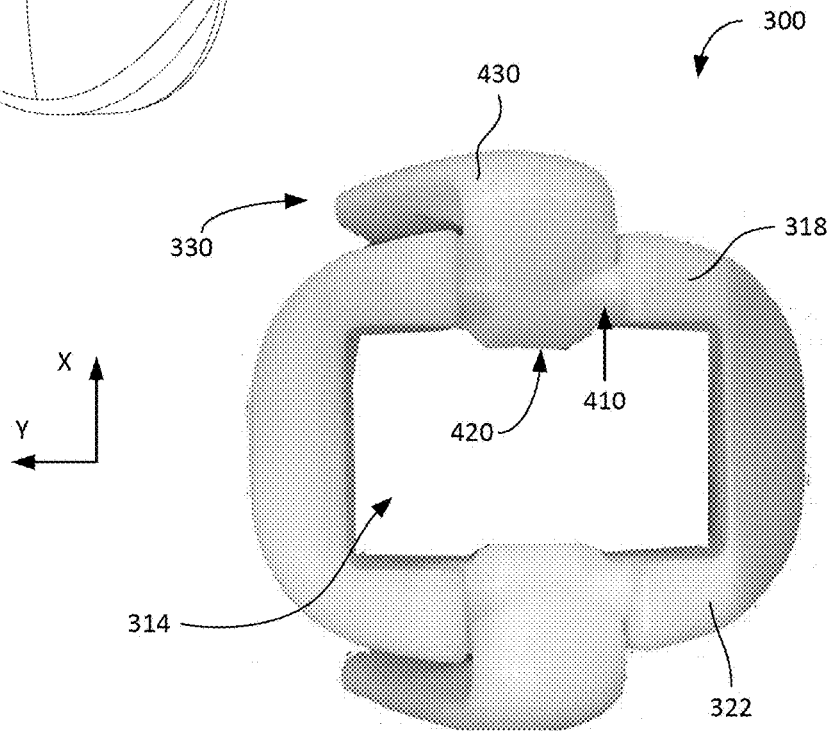
FIG. 5 provides a top plan view of an embodiment of the invention (wit exception of ergonomic surface reliefs seen in FIGS. 3A, 3B).

To this end, as shown schematically in perspective views in FIGS. 3A, 3B, and in a top view in FIG. 5, an embodiment 300 of the invention includes a projectile-container receiving body 310 (which is this case is a monolithic body, but in related embodiments may contain constituent parts that are assembled and affixed to one another). The receiving body 310 is dimensioned to receive therein a body 210 of the projectile container (with which the embodiment 300 is configured to be paired) along the receiving body axis 312. In this example, the receiving body 310 is shown to be configured as a tubular element defining a hollow or internal opening 314 that extends throughout the tubular element along the axis 312 (here, the z-axis of the local coordinate system) and that has opposing each other wall portions 318, 322. The embodiment 300 further includes at least one (and, preferably, a plurality of) release cam 330. Some of the facets (outer surfaces) of the body 310 are shown to include the generally optional surface relief features (which in this case are shown as grooves and/or lettering) use when so desired for ergonomic operation of the embodiment.

In further reference to FIG. 4, the release cam 330 generally includes a hinge or hinge fastener 410 (shown here as having a rod-like shape and having an axis 410A), a camming body 420 integrated with the hinge 410 at one side of the hinge, and a cam lever 430 cooperated with the hinge and the camming body such as to be separated from the camming body by the hinge. Optionally, the release cam 330 may be complemented with a structural gusset 440, which—when present—is preferably configured as a reinforcement implement that enhances the structural integrity of the corresponding release cam 330 and the strength of the structural cooperation of the cam lever 430 and the camming body 420.

A given release cam 330 is preferably cooperated with an edge of a corresponding wall portion (of wall portions of the receiving body 310 that oppose one another) such as to have a hinge 410 to be received and accepted by a corresponding hinge-mounting element of the hosting wall portion and to remain freely rotatable about the axis 410A in such hinge-mounting element. The hinge mounting element can be dimensioned as a corresponding notch or groove (seen in the inner surface of the wall portion 318 of FIG. 3A, for example, and shown on a larger scale as 630 in FIG. 6B, discussed below), into which the hinge 410 can be (removably) snapped. In a related alternative situation, when the embodiment 300 is completely formed using a 3D printing or additive manufacturing process as known in related art, the hinge mounting element may be dimensioned to have a shape substantially reciprocal to that of a hinge (for example, when the hinge 410 is shaped as a rod, as shown in FIG. 4, the hinge mounting element can be dimensioned to include a cylindrical groove in the wall portion of the body 310 hosting such hinge.

Figure 8:
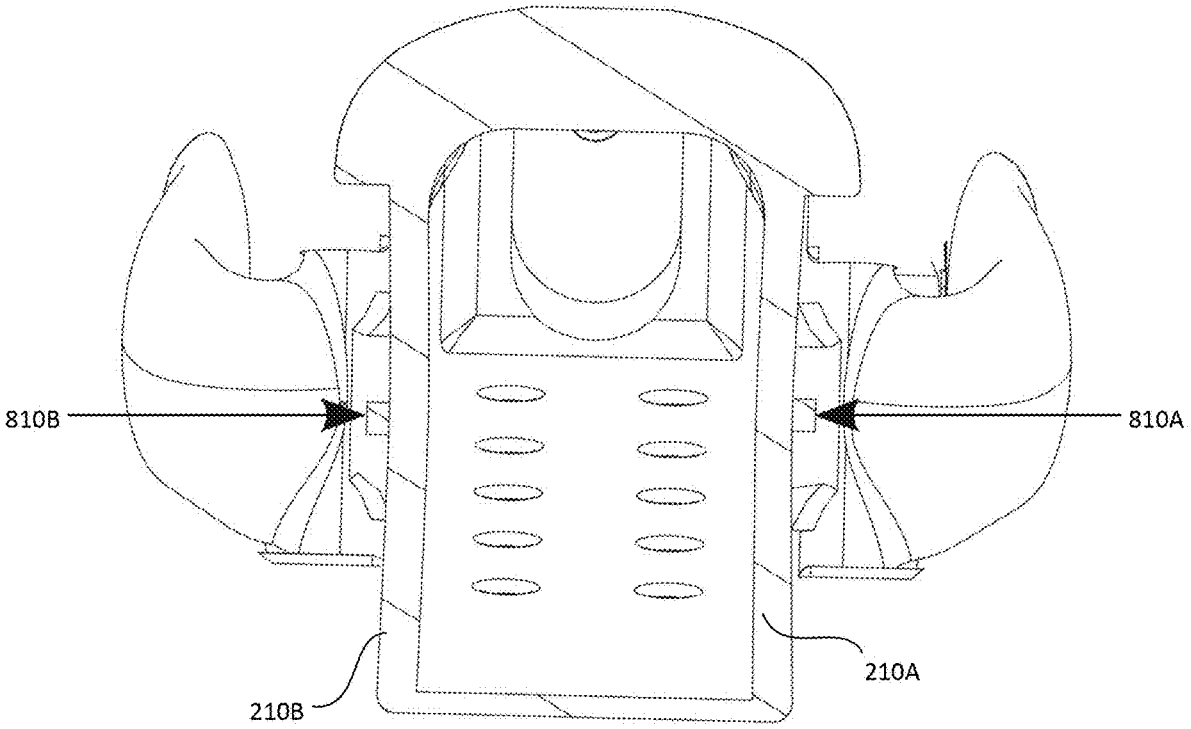
FIG. 8 is a diagram illustrating the elastic deformation of the walls of the target projectile container engaged by the release cams of the embodiment of the tool of the invention, causing reversible inwardly displacement of the locking tabs of the container.
Figure 9A:
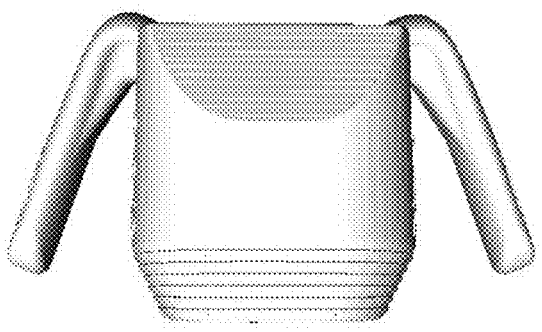
FIGS. 9A, 9B, 9C, and 9D provide various elevational and plan views of an embodiment substantially similar to that of FIGS. 3A, 3B. Here, FIG. 9A provides a view from the back.
Figure 9B:
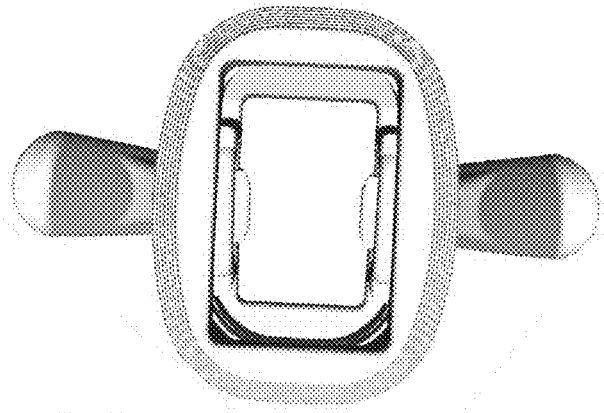
Figure 9C:
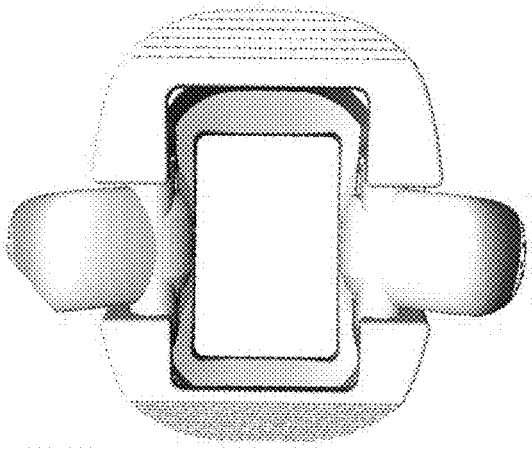
Figure 9D:
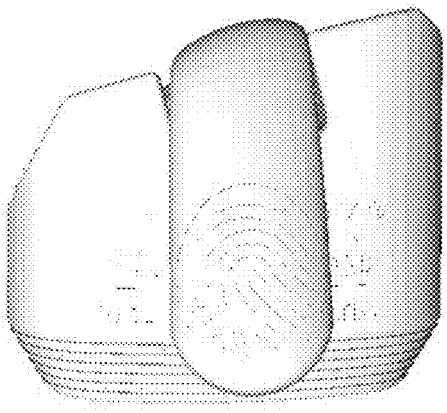
Figure 10A:
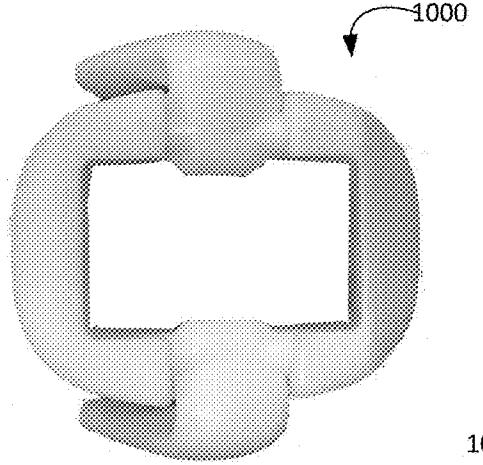
FIGS. 10A, 10B, 10C, 10D, 10E, and 10F provide various elevational and plan views of a related embodiment of the tool of the invention, this time configured to contain multiple parts assembleable with one another. Specifically.
Figure 10B:
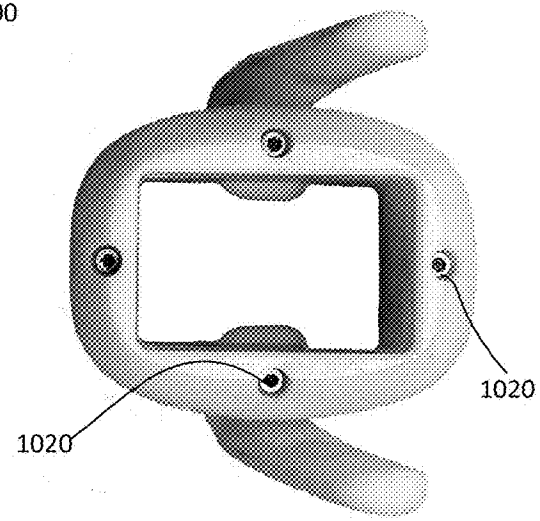
Figure 10C:
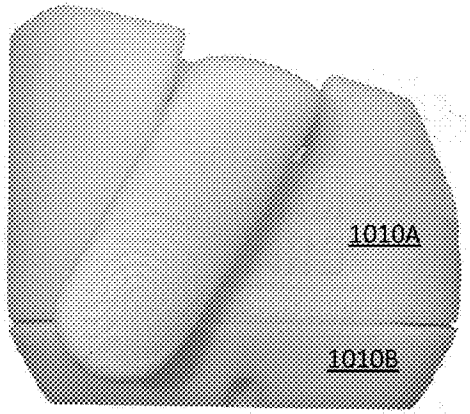
Figure 10D:
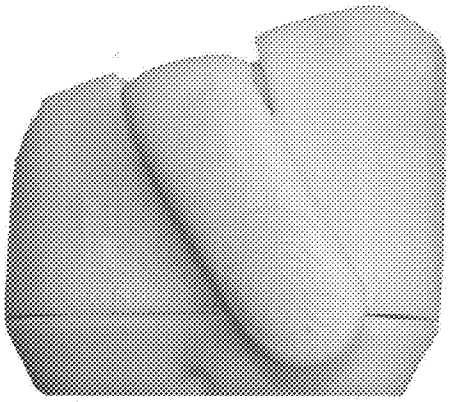
Figure 10E:
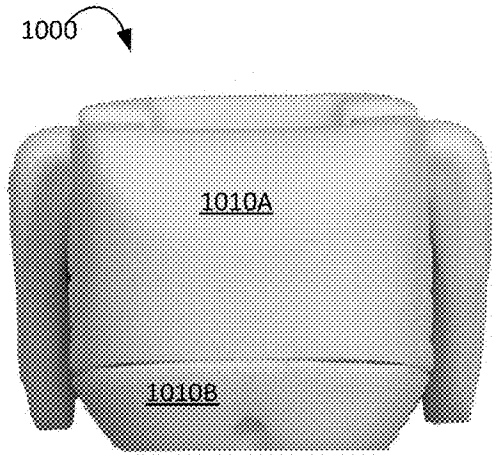
Figure 10F:
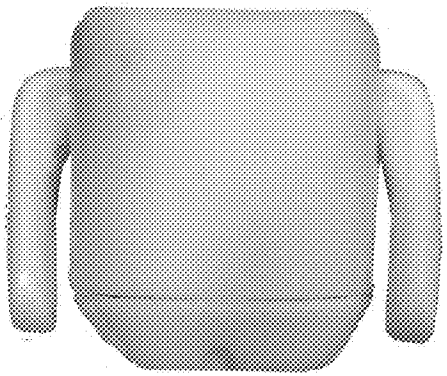

When assembled with (for example, snapped into) the receiving body 310, a given release cam is hinged in the hinge mounting element at an edge region of a chosen wall portion (318, 322) with the cam lever 430 being outside of such wall portion. Generally, the hinge mounting element is configured such as to orient the axis 410 of rotation of the release cam 330 substantially in the plane of the corresponding hosting wall portion (318, 322). In one case, such orientation may be chosen to be substantially in the plane transverse (and, preferably, perpendicular) to the axis 312. As a skilled artisan readily appreciates, the rotation of the release cam 330 (that has been cooperated with the hosting wall portion of the body 310) about the axis 410A reversibly reorients the release cam 330 between the "engaged" position (in which the camming body 420 is within the internal opening 314 of the receiving body 310 and comes in contact with a wall of the body 210 of the projectile container 200 when such container is inserted into and accepted by the internal opening 314) and "disengaged" position (in which the camming body 420 is repositioned away from and is not present in the internal opening 314). FIG. 5, for example, illustrates the release cam 330 oriented to be in the "engaged" position, in which the camming body 420 would make sliding contact with the body 210 of the projectile container 200 (if such container were inserted in the internal opening 314), to impart a variable motion to a wall of the container 200. Similarly, FIG. 8 provides, in a diagrammatical cross-section, a view of the embodiment of the invention engaged with the body of the projectile container that shows the locking tabs 810A, 810B being displaced from their rest positions inwardly, towards the axis of the body 210 (which axis is substantially perpendicular to the plane of FIG. 8) as a result of the camming bodies 420 of the release cams (rotated to engage with the walls 210A, 210B. The attention of the skilled artisan is drawn to a slight inwardly directed curvature of the walls 210A, 210B resulting from the elastic deformation of these walls produced by direct engagement of the walls with the camming bodies of the corresponding release cams: due to such curvature, the separation between the locking tabs is now smaller than that in the rest state of the body 210 (that is, when the body 210 is not engaged with the camming bodiy(ies) 420).

Figure 6B:
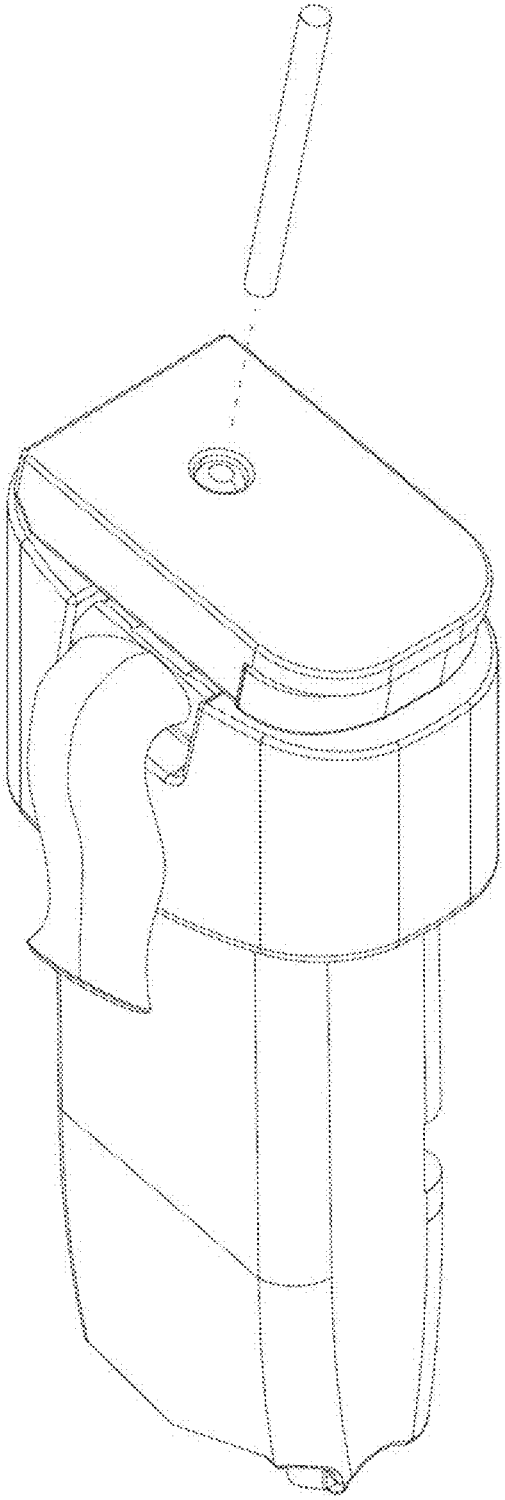
FIGS. 6B, 6C are perspective views of the embodiment engaged with and holding the target projectile container, having released a locking tab(s) from the corresponding notch(es) of the terminating element. Additionally, shown is a dowel used to disengage the spring plate along the base plate.

FIGS. 6A, 6B, 6C, and 6D provide additional illustrations intended to assist a skilled artisan in understanding of embodiments of the invention and operation of such embodiments. FIG. 6A schematically illustrates the dimensional matching between the body 210 of the projectile container 200 and the embodiment 300 of FIG. 3A, for example. FIG. 6A also illustrates the operational cooperation (or, alternatively, disengagement of the two along the arrow 610).

It is appreciated, that at least one implementation of the tool of the invention is judiciously dimensioned to ensure that the distance between the wall portions 318, 322 satisfies at least one of a running fit criterion and a sliding fit criterion for a space between the body of a projectile container and a surface of the receiving body when the body of the projectile container is inserted into the receiving body. (Such running fit and sliding fit being defined according to ANSI B4.1 standard, well recognized and used and adhered to in related art. See, for example, ANSI B4.1-1967, R1974 Standard Limits and Fits, available at cobanengineering.com/tolerances) As a skilled person will readily appreciate, several running and/or sliding fits are often used in related art, as referred to below, with the smaller RC numbers representing smaller clearances for tighter fits and the larger numbers representing larger clearances for looser fits. See also en.wikipedia.org/wiki/Engineering_fit.

Examples of such fits include: a) RC1: close sliding fits, intended for the accurate location of parts which must assemble without noticeable play. b) RC2: sliding fits intended for the accurate location but with greater maximum clearance than class RC1. C) Parts made to this fit turn and move easily. This type is not designed for free run. Sliding fits in larger sizes may seize with small temperature changes due to little allowance for thermal expansion or contraction. d) RC3: precision running fits are about the closest fits that can be expected to run freely. Precision fits are intended for precision work at low speed, low bearing pressures, and light journal pressures. e) RC3 is not suitable where noticeable temperature differences occur. f) RC4: close running fits, which are mostly for running fits on accurate machinery with moderate surface speed, bearing pressures, and journal pressures where accurate location and minimum play are desired. Fits of this kind also can be described as smaller clearances with higher requirements for precision fit. g) RC5 and R6: medium running fits designed for machines running at higher running speeds, considerable bearing pressures, and heavy journal pressure. Fits of this kind also can be described with greater clearances with common requirements for fit precision. h) RC7: Free running fits intended for use where accuracy is not essential, suitable for great temperature variations. This fit is suitable to use without any special requirements for precise guiding of shafts into certain holes. i) RC8 and RC9: loose running fits intended for use where wide commercial tolerances may be required on the shaft. With these fits, the parts with great clearances with having great tolerances. Loose running fits may be exposed to effects of corrosion, contamination by dust, and thermal or mechanical deformations.

Figure 6C:
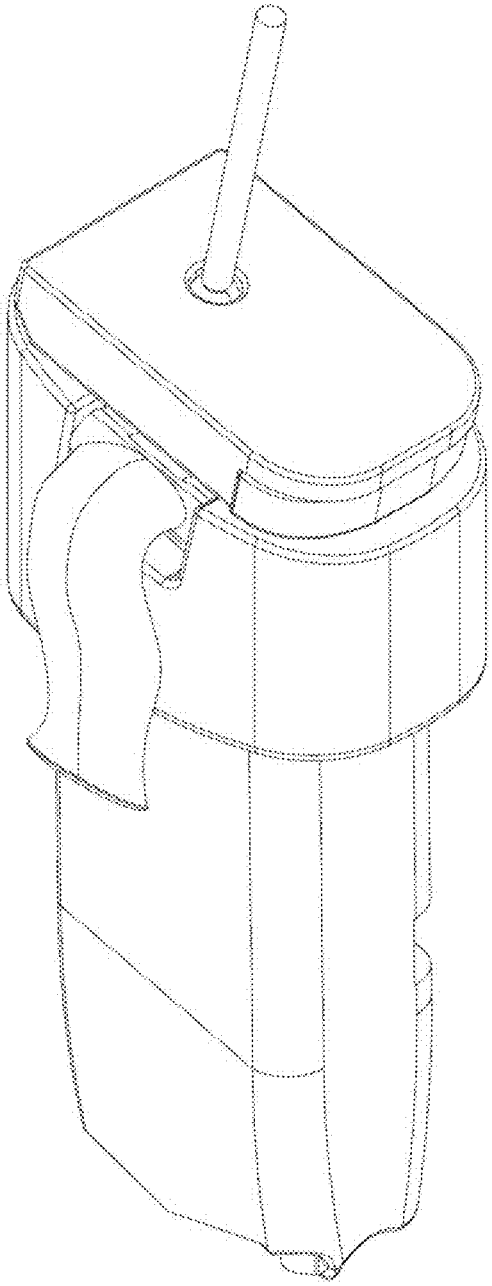
Figure 6D:
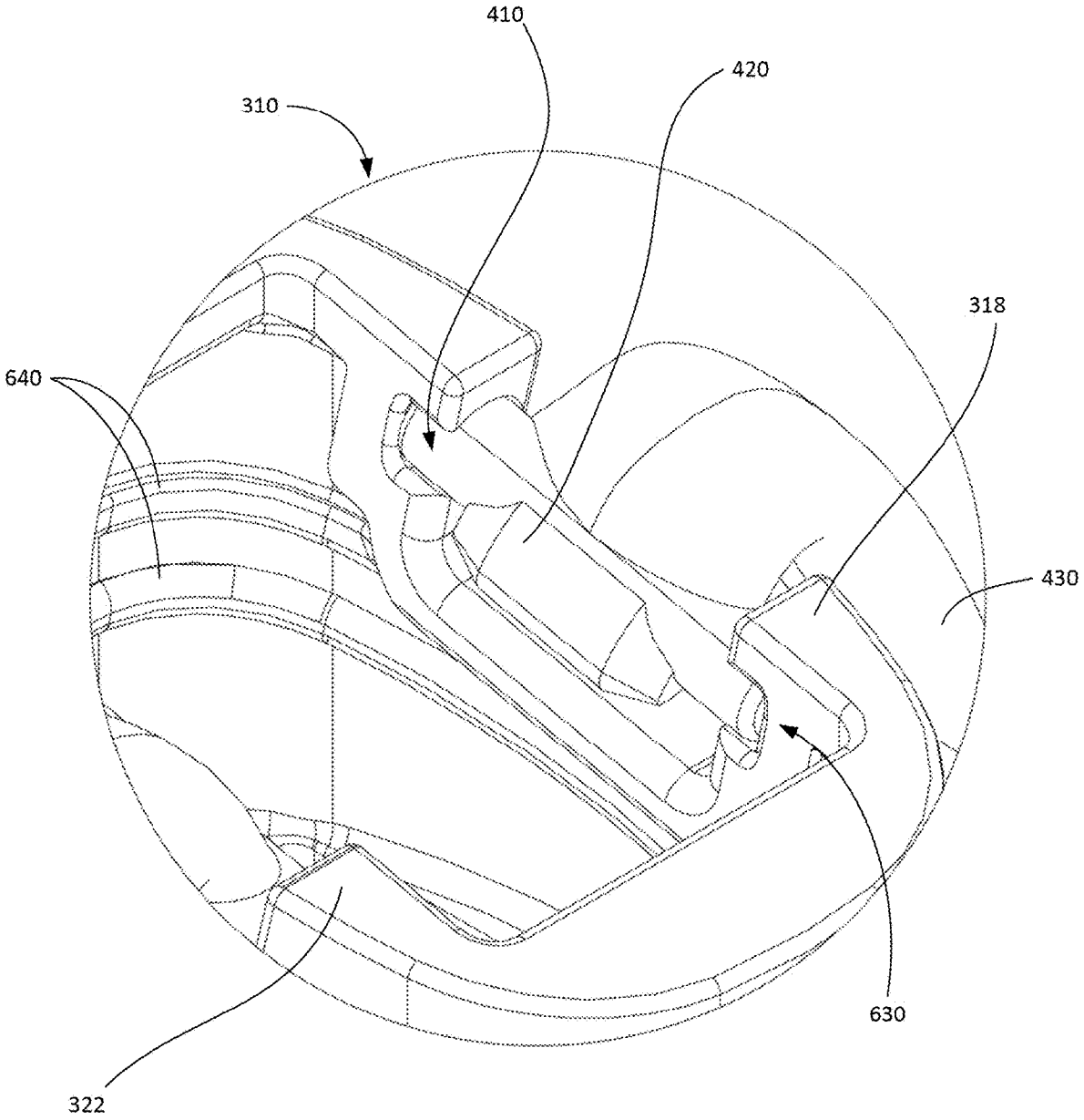
FIG. 6D is a detailed view (inset) of a portion of the embodiment of the invention identified in FIG. 6A.

Referring again to FIGS. 6A, 6B, during the procedure resulting in engagement of the walls of the projectile container with the camming body(ies) of the embodiment of the tool, the release cam(s) 310 of the tool 300 are rotated to ensure that the camming body(ies) 420 are not obstructing the internal opening 314 of the body 310 (that is, the release cam(s) are in the disengaged position), and body 210 of the projectile container 200 is inserted into the internal opening 314 until the terminating element 220 (or the corresponding edge surface of the body 210 with the locking tabs) substantially comes in contact with the upper edge surface of the embodiment 300. At that moment, constituent release cam(s) 330 are rotated about the corresponding hinge(s) 410 to engage and elastically bend the walls 210A, 210B of the projectile container. This situation is illustrated in FIGS. 6B, 6D. Additionally, FIGS. 6B, 6C depict the release of an "feed lip" plate (interchangeably referred to as a spring plate) internally cooperated with the spring inside the body 210 of the projectile container 200 through the opening 220A of the terminating element 220, with the use of an elongated rod-like pusher (a dowel, shown here as 620), by pushing the feed lip plate aside internally to the body 210 as known in related art, prior to removing (sliding) the element 220 from the body 210.

Figure 6E:
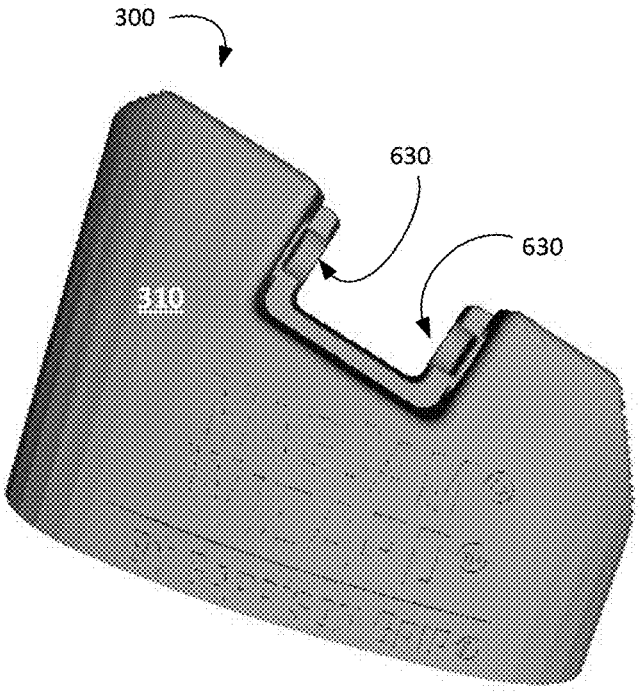
FIGS. 6E, 6F provide additional perspective views of the embodiment of FIG. 3A with the release cams removed.
Figure 6F:
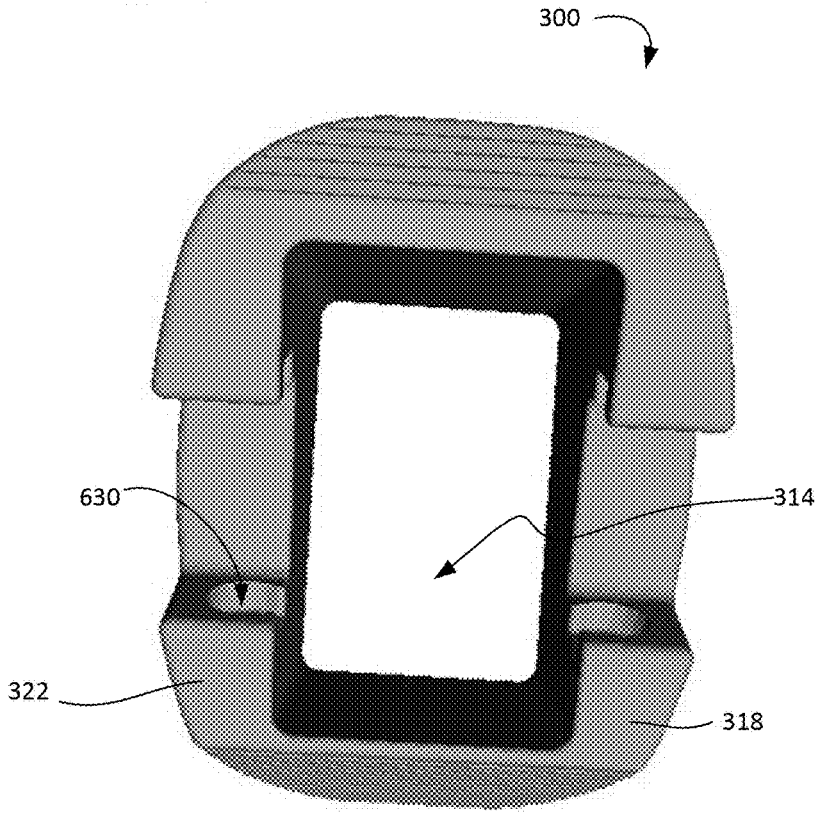

FIG. 6D provides additional details of the structure of the embodiment 300 in a detailed view of a portion of FIG. 6A, including the hinge mounting element(s) 630 and the optional ribs of ridges 640 formed on the internal surface of the opening 314 to increase the structural strength and integrity of the body 310. FIG. 6E provides a side view of the embodiment of FIG. 3A (as seen along the x-axis, with some indicia representing applicable trademarks visible on the surface of the receiving body 310) with the release cam 330 removed, thereby exposing the hinge mounting element 630 for unobstructed view. FIG. 6F provides an additional perspective view of the embodiment 300 with both of release cams removed, for clear view of the elements of the structure of the receiving body.

Figure 7:
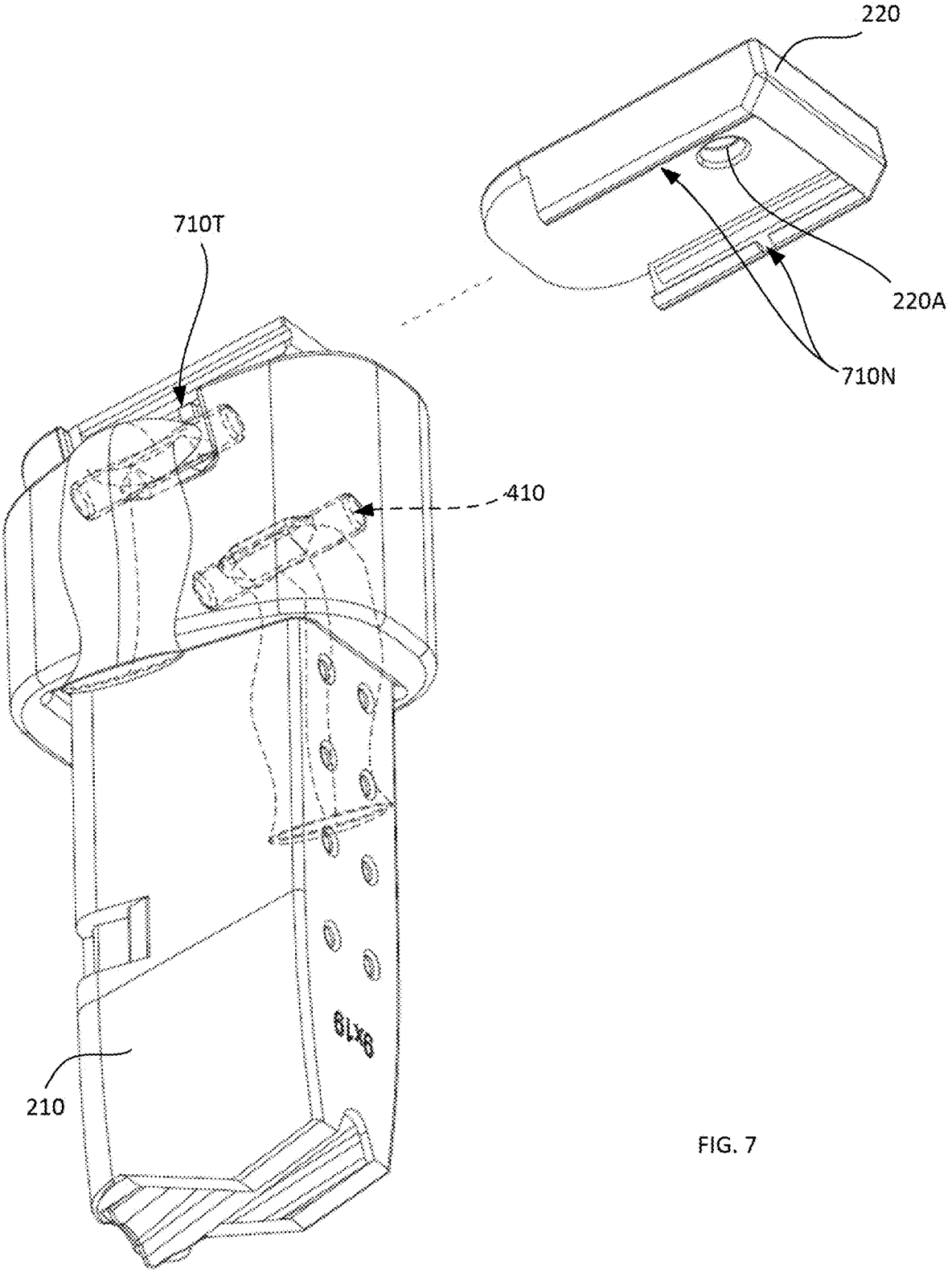
FIG. 7 is a related perspective view illustrating the terminating element having been released from the body of the projectile container, while the embodiment of the tool of the invention is maintained in engaged position thereby keeping the plurality of locking tabs of the body of the projectile container displaced for ease of replacement of the terminating element.

FIG. 7 illustrates, in perspective view, a moment when the terminating element 220 has been reversibly dis-attached and removed from the body 210 of the projective container. Here, both of the constituent release cams of the embodiment 300 of the tool of the invention are shown to be still in the engaged position (when the corresponding camming bodies are "squeezing" the opposing walls of the projectile container), which engagement resulted in the release of the locking tabs (one is shown as 710T) from the corresponding tab-accommodating notches of the terminating element (shown as 710N).

It is understood, therefore, that generally the projectile-container receiving body 310 of the embodiment 300 of the tool of the invention takes a form of the main chassis of the baseplate removal tool 300, which chassis is dimensioned to secure the constituent components of the baseplate removal tool. The receiving cavity of the tool 300 takes the form of an insertion opening that is configured to receive the projectile container (a firearm magazine, in one case). A release cam of the tool 300 takes the form of a compression element configured to disengage a locking tab that holes the structural terminating element 220 via structural cooperation with a tab-accommodating notch of such terminating element. In particular, the camming body 420 is configured as the cam compressive element judiciously dimensioned to exert compressive force (at the body of the projectile container) of a precise amount to reposition a locking tab of the body 310 out of the tab-accommodating notch of the terminating element to release the locking tabs from the terminating element. A hinge mounting element 630 of the embodiment 300 takes the form of a channel specifically dimensioned to receive the hinge 410 to mount the corresponding release cam to the receiving body 310. A cam lever 430 takes the form of a leveraging implement, configured as a leverage handle to the camming body 420. More specifically, the cam lever is configured to rotate the camming body about the hinge axis 410A from the disengaged position to the engaged position. Furthermore, camming lever 430 serves as a compressive retention implement to disengage the locking tab, and to allow the user to retain the engaged position of the camming body during the process of replacement/removal/re-installment of the termination element 220. Generally, the constituent components of the embodiment 300 may be made out of any suitable material such as, without limitations, a polymer composite, or plastic and/or metal such as aluminum, for example.

Referring again to the illustrations provided in FIGS. 3A, 3B it is understood that the receiving body 310 generally has a shape suitable for providing ergonomic features to the user. For example, in at least one case the receiving body 310 may optionally include a plurality of bottom grip elements and/or a plurality of upper clearance cuts (shown in FIGS. 3A, 3B as surface relief "grooves" on the facets of the body 310). The plurality of bottom grips, when present, serves as ergonomic handling implements that allows the user to better handle and secure the magazine receiving body towards the baseplate portion of the projectile container. The plurality of upper clearance cuts, when present, is configured to provide ample clearance for the firearm terminating element to slip on or off of the body 210 that has been secured in and along the receiving body 310. Optionally, the plurality of bottom grip elements and the plurality of upper clearance cuts are distributed terminally opposite to each other along the receiving body 310.

FIGS. 9A, 9B, 9C, and 9D schematically illustrate several elevational and plan views of the embodiment of FIGS. 3A, 3B. FIGS. 10A, 10B, 10C, 10D, 10E, and 10F provide, respectively, a top view, a bottom view, a side view, another side view, a front view, and a back view of a related embodiment 1000 of the invention, in which the body 1010 is shown to be not monolithic (in contradistinction with the body 310 of the embodiment 300) but to optionally include multiple parts (in this specific but not limiting example—the top part 1010A and the bottom part 1010B) assembled together with the use of fasteners 1020 visible in FIG. 10B. This version of implementation of the idea of the invention may be preferred when the embodiment is to be complemented with the internal structural ribs/armature 1130, placed in judiciously defined cavity/ies 1140 in the walls of the top part 1010A, and then "capped" with or closed by the bottom part 1010B configured as a lid of sorts: this optional structure will be understood by a skilled artisan from the illustrations provided by FIGS. 11A, 11B A skilled artisan having the advantage of this disclosure now readily appreciates that embodiments of the tool structured according to the idea of the current invention assures the integrity and critical function of the firearm magazine, where other tools of related art used for the same purpose do not. The discussed tool allows for consistent positive pressure that is always just enough to serve its purpose without compromising the functionality of the firearm magazine while, at the same time, creating the operational an environment where in setting the cams in place, the user can have hands free access to the task at hand of either removing or installing, the inner spring, spring plate, base plate, or any size grip extension.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. In one specific case, the terms "approximately", "substantially", and "about", when used in reference to a numerical value, represent a range of plus or minus 20% with respect to the specified value, more preferably plus or minus 10%, even more preferably plus or minus 5%, most preferably plus or minus 2% with respect to the specified value.

The use of these terms in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated falls and may vary within a numerical range defined by an experimental measurement error that is typical when using a measurement method accepted in the art for such purposes. Other specific examples of the meaning of the terms "substantially", "about", and/or "approximately" as applied to different practical situations may have been provided elsewhere in this disclosure.

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In addition, it is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed. Furthermore, the described single features, structures, or characteristics of the invention may be combined in any suitable manner in one or more further embodiments.

Disclosed aspects, or portions of these aspects, may be combined in ways not listed above. Accordingly, the invention should not be viewed as being limited to the disclosed embodiment(s).

What is claimed is:

1. A projectile container tool comprising:

a receiving body that has an axis and that includes first and second wall portions opposite to one another and extending along the axis, the first and second wall portions being separated from one another in a plane transverse to the axis by a distance to form an internal opening of the receiving body, the internal opening being dimensioned to removably accommodate a body of a projectile container between the first and second wall portions; and at least one release cam having a cam lever and a camming body, the at least one release cam configured to be hinged at an edge region of a chosen wall portion of the first and second wall portions with the cam lever being outside of the chosen wall portion, wherein the at least one release cam is further configured to move between an engaged position where the camming body protrudes into the internal opening and a disengaged position where the camming body does not protrude into the internal opening, and wherein the camming body is dimensioned to reversibly reposition a locking tab of the body of the projectile container to release said locking tab from a tab-accommodating notch of a structural element that is removably cooperated with and terminates the body of the projectile container.

2. A tool according to claim 1, wherein an inner surface of the internal opening includes at least one ridge extending towards the axis, and/or wherein the at least one release cam includes a structural gusset at the cam lever.

3. A tool according to claim 1, wherein the internal opening is dimensioned to have said distance satisfy a running fit or a sliding fit between the body of the projectile container and a surface of the receiving body, said running fit or said sliding fit being defined according to ANSI B4.1 standard.

4. A tool according to claim 1, wherein the receiving body is configured as a tubular element having the internal opening dimensioned to removably accommodate said body of the projectile container therein.

5. A tool according to claim 1, wherein said at least one release cam includes first and second release cams, each of the first and second release cams having a corresponding cam lever and a corresponding camming body, the first release cam configured to be hinged at an edge region of the first wall portion opposite to the second release cam that is configured to be hinged at an edge region of the second wall portion with the corresponding camming body of the first and second release cams facing each other inside the internal cavity.

6. A tool according to claim 1, wherein the at least one release cam is configured to be hinged at said edge region to be rotatable about a hinge axis passing substantially parallel to the chosen wall portion.

7. A tool according to claim 1, wherein at least one wall portion of the first and second wall portions of the receiving body is hollow and/or contains a strengthening rib in a body of the at least one wall portion of the first and second wall portions, and/or wherein the at least one wall portion contains a strengthening rib.

8. A tool according to claim 1 further comprising at least one hinge mounting element at the edge region of the chosen wall portion which is dimensioned to accommodate a hinge of the at least one release cam therein.

9. A tool according to claim 1, wherein the camming body is configured as a compressive element dimensioned to come in contact with and to elastically deform a wall of the body of the projectile container when the projectile container is removably accommodated between the first and second wall portions and when the cam lever is rotated about a hinge of the at least one release cam.

10. A tool according to claim 1, wherein said structural element is a baseplate of the body of the projectile container or an extension of the body of the projectile container.

11. A tool according to claim 1, wherein said projectile container is a firearm magazine.

12. A tool according to claim 1, wherein the receiving body is either monolithic or includes constituent portions reversibly affixable to one another.

13. A method comprising:

removably inserting a body of a projectile container into the internal opening of the receiving body of the projectile container tool according to claim 1 along the axis;

hingedly rotating the at least one release cam about a hinge thereof disposed at the chosen wall portion of the receiving body to engage the camming body of the at least one release cam with a surface of the body of the projectile container and to release a locking tab of the body of the projectile container from a corresponding tab-accommodating notch of a structural element that is removably cooperated with the body of the projectile container to terminate the body of the projectile container.

14. A method according to claim 13, further comprising disconnecting said structural element from the body of the projectile container by moving said structural element in a first direction.

15. A method according to claim 14, wherein said moving is unhindered by interaction between the tab-accommodating notch and the tab.

16. A method according to claim 14, further comprising removably securing said structural element with the body of the projectile container by:

moving said structural element in a second direction that is opposite to the first direction until the tab-accommodating notch of the structural element is aligned with the locking tab of the body of the projectile container while said body of the projectile container is engaged with the camming body in the internal opening of the receiving body, and hingedly rotating the at least one release cam about the hinge thereof to disengage the camming body of the at least one release cam from the surface of the body of the projectile container.

17. A method according to claim 16, further comprising engaging the tab within the tab-accommodating notch by said hingedly rotating the at least one release cam to disengage the camming body from the surface of the body of the projectile container.

18. A method according to claim 13, wherein said at least one release cam includes first and second release cams disposed on the receiving body opposite to one another and separated from one another by the internal opening of the receiving body, and wherein said hingedly rotating includes rotating the first release cam and rotating the second release cam to elastically deform two opposite walls of the body of the projectile container inserted into the internal opening.

19. A method according to claim 13, (20A) wherein said removably inserting includes inserting the body of the projectile container into the internal opening of said receiving body configured as a tubular element; and/or (20B) wherein said removably inserting includes inserting the body of the projectile container into the internal opening of the receiving body when the at least one release cam is oriented with the camming body not protruding into the internal opening and the cam lever being substantially transverse to an outer surface of the receiving body, or wherein said removably inserting includes inserting the body of the projectile container into the internal opening of the receiving body when the at least one release cam is oriented with the camming body not protruding into the internal opening and the cam lever extending along the outer surface of the receiving body.

* * * * *